United States Patent [19]

Gibb et al.

[11] Patent Number: 4,567,842

[45] Date of Patent: Feb. 4, 1986

[54] WEIGHT TYPE MOTION COMPENSATION SYSTEM FOR A RISER MOORED TANKER

[75] Inventors: Peter R. Gibb, Port Coquitlam; Pius Bartsch, Surrey, both of Canada

[73] Assignee: Novacorp International Consulting Ltd., Alberta, Canada

[21] Appl. No.: 619,736

[22] Filed: Jun. 12, 1984

[30] Foreign Application Priority Data

May 2, 1984 [CA] Canada ..... 453365

[51] Int. Cl.[4] ..... B63B 21/00

[52] U.S. Cl. ..... 114/230; 441/5

[58] Field of Search ..... 114/230; 441/3-5; 212/156, 178, 191, 195, 196-198; 166/355; 414/601, 602, 673, 719; 254/127 R, 209, 227, 129, 130, 131.5

[56] References Cited

U.S. PATENT DOCUMENTS

| | | | |
|---|---|---|---|
| 2,560,463 | 7/1951 | Matson | 254/130 |
| 3,605,668 | 9/1971 | Morgan | 441/5 |
| 3,895,677 | 7/1975 | Bokenkamp | 166/315 |
| 3,918,379 | 11/1975 | McNary et al. | 114/264 |
| 3,919,379 | 11/1975 | Graham et al. | 114/264 |
| 3,939,991 | 2/1976 | Person | 114/265 |
| 4,128,229 | 12/1978 | Elliston | 254/139 |
| 4,176,722 | 12/1979 | Wetmore et al. | 166/355 |
| 4,309,955 | 1/1982 | Kentosh | 114/230 |

FOREIGN PATENT DOCUMENTS

| | | | |
|---|---|---|---|
| 2411755 | 8/1979 | France | 114/230 |
| 1574530 | 9/1980 | United Kingdom | 114/264 |
| 2141470 | 12/1984 | United Kingdom | 114/264 |

OTHER PUBLICATIONS

"Gravity-Base SALS at Tazerka" from Offshore Europe, Tanker Production Eyed for Deep, Rough Seas in Offshore, Mar. 1983.

*Primary Examiner*—Galen L. Barefoot
*Assistant Examiner*—Jesûs D. Sotelo
*Attorney, Agent, or Firm*—Stevens, Davis, Miller & Mosher

[57] ABSTRACT

A system for mooring a ship-shape floating production system using a riser tensioned by a weight type motion compensation system. The riser is attached to the ship by a rocking beam that has a weight attached at one end of the beam to balance the vertical load component of the riser attached at the other end of the beam. A rocker arrangement is used whereby the beam support point moves to compensate for the inertial forces of the weight caused by the vertical accelerations of the tanker. Thus the high load fluctuations and hence poor riser fatigue life usually associated with weight type motion compensators is minimized. A gear arrangement is used to transmit horizontal loads. The overall arrangement provides a totally self-contained motion compensation and riser handling system that requires minimal ship modifications and is independent of significant self-induced wave loading.

14 Claims, 5 Drawing Figures

WEIGHT TYPE MOTION COMPENSATION SYSTEM FOR A RISER MOORED TANKER

FIELD OF INVENTION

This invention relates to methods and apparatus that provide mooring of a floating vessel for the purpose of producing subsea oil fields.

BACKGROUND

This invention is a development of a method of mooring a floating production and storage vessel (tanker) described in copending U.S. patent application Ser. No. 619,734. The present invention specifically relates to the method and apparatus for connecting the mooring riser to the floating vessel and allowing for relative motion between the two.

Patent application Ser. No. 619,734 discloses a method whereby the tanker is moored directly from the production riser that is deployable from the tanker. One advantage of this system is that it is very mobile and relatively insensitive to water depth. The complete floating system can therefore be deployed from one location to another quickly with negligible modifications and low cost.

Another feature of the mooring system is that it is not subjected to large wave loading. In most existing or proposed floating production mooring systems some form of buoyancy is incorporated in the system to provide a vertical force. This buoyancy is usually in the form of a buoy, with a buoyant tower or a buoyant yoke joining a tower to the tanker. The buoyant structure is of necessity large and in the wave zone which subjects it to very large forces. Although these forces are secondary in nature to the primary forces of mooring the tanker they are usually the dominant structural load. Patent application Ser. No. 619,734 uses a small diameter riser with no other mooring apparatus in the wave zone enabling a lighter structure to be used. For that particular invention an hydraulic motion compensation method was used. A further U.S. patent application filed June 12, 1984, Ser. No. 619,735 discloses a different method of motion compensation whereby a buoyancy can within the tanker provided the riser vertical reaction loads.

SUMMARY OF THE INVENTION

According to one broad aspect the invention relates to a weight type motion compensation system for a riser moored tanker, said system comprising a rocking beam attaching a riser to said tanker, a weight attached to the end of the beam remote from the riser; said rocking beam providing means whereby the beam support point moves to compensate for inertial accelerations of said tanker.

According to another broad aspect the invention relates to a system wherein the weight comprises a fluid-filled tank.

BRIEF DESCRIPTION OF THE DRAWINGS

The invention is illustrated in the accompanying drawings in which.

DESCRIPTION OF INVENTION

Figure 1:
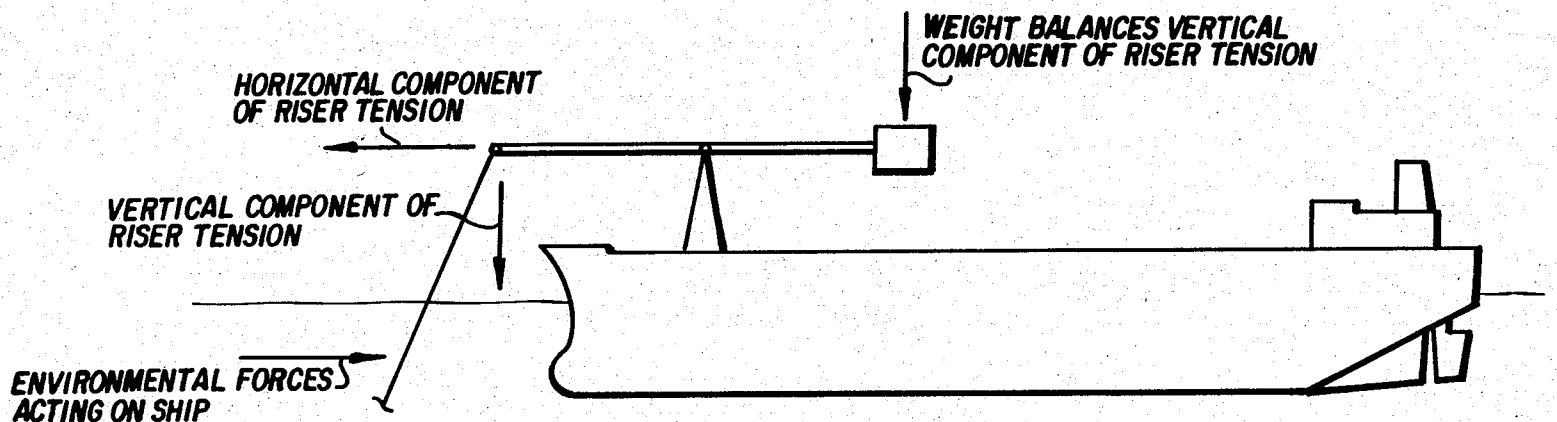
FIG. 1 is a diagrammatic elevation view illustrating forces acting on the ship.

The present invention seeks to provide an "inert" or passive method of motion compensation between the riser and the tanker that minimizes secondary forces, and is universal in its application. The secondary forces referred to here are drag forces on buoyancy cans and inertia of the apparatus. The objective is to reduce the load fluctuations in the riser in order to increase the fatigue life. The known devices use a pivoting beam whereby the riser is attached at one end and a counterweight is attached to the other end. FIG. 1 shows the method diagrammatically. Vertical loads from the riser are thus balanced by the weight, and horizontal loads from the riser are transmitted to the tanker via the pivot. The vertical motion of the tanker is accommodated by the beam pivoting. Although this is a classical mechanism, its use in mooring a tanker requires modifications in order to make it practical.

Figure 2:
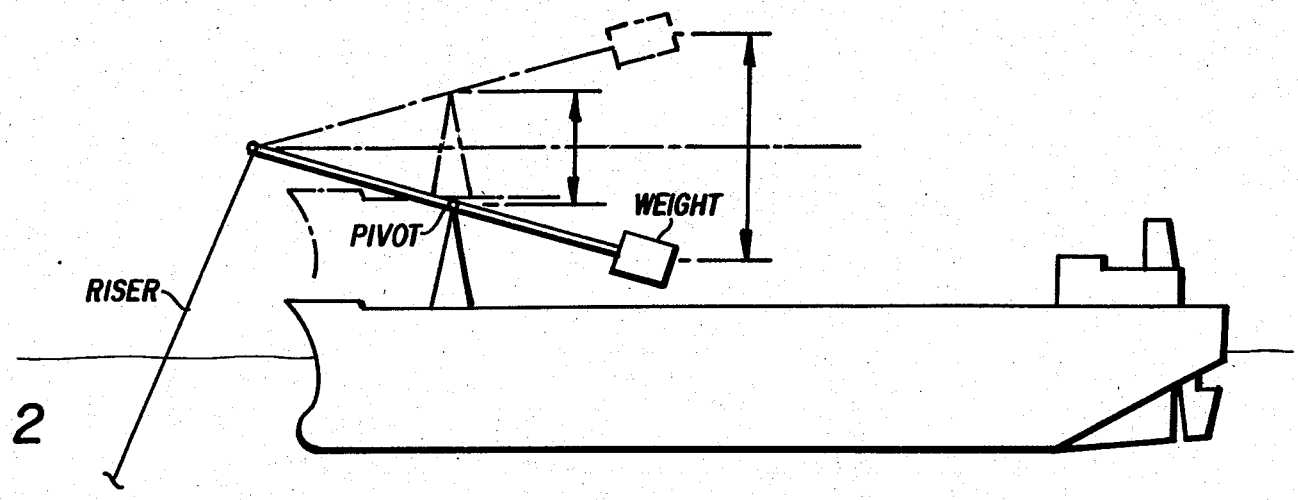
FIG. 2 is a view similar to FIG. 1.

The purpose of the motion compensation is to uncouple the vertical motion of the tanker from the riser. The vertical motion of the tanker accelerates the counter balance weight resulting in an inertia load, directly changing the riser tension. The acceleration of the weight is not just the acceleration of the tanker at the pivot point but is factored up to the lever arm, FIG. 2. Thus if the pivot is equidistant between the riser and weight, a factor of 2 applies. This result is inherent to any weight system where the weight is used to apply an upward vertical force. For instance if the weight were hung on a cable that passed up over a sheave and down to the riser, the weight would travel twice the distance relative to the sheave and thus have twice the acceleration (assuming that the riser remains stationary and the sheave moves). This weight, cable and sheave arrangement has been used in the past for motion compensation of drilling risers because it is so simple, but is no longer used because of the high inertia load fluctuations. The present invention significantly reduces the inertia effects of weight type motion compensation.

Figure 3:
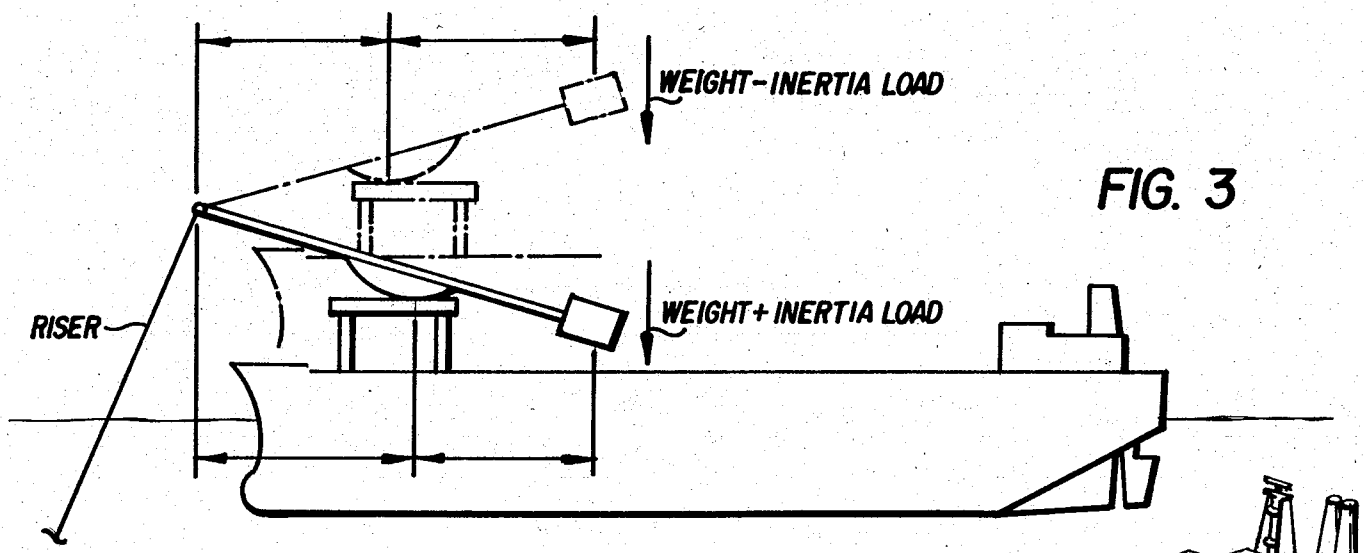
FIG. 3 illustrates changes in forces using the present invention.

The load in the riser is proportional to the weight and the beam/pivot geometry. The present invention provides a means of changing the beam/pivot geometry in proportion to the change of inertia, i.e. the pivot point is moved to compensate for the change of inertia load. This is accomplished by substituting the pivot with a rocking surface with the size and shape of the rocker being chosen to suit the characteristics required, FIG. 3.

The motion of the tanker at the pivot point will be approximately sinusoidal. When the weight is at the lowest point its velocity will be zero and its acceleration will be at a maximum, increasing the downward force due to the weight. For this condition the pivot point needs to be near the weight to reduce the moment arm for the weight and increase the moment arm for the riser. Conversely, when the weight is at its highest position the weight again has zero velocity and maximum acceleration but in the opposite direction, decreasing the downward force due to the weight, Thus for this case the pivot needs to be near the riser. These are the two extreme positions for the pivot point. Intermediate positions can be derived based on the motion of the weight. If the motion is sinusoidal then a rocker based on an arc of a circle provides the correct location of the pivot point throughout the range.

The rocker arrangement described above allows the pivot point to move and also supports the weight of the complete rocking beam. But it cannot transmit any horizontal load — which is the primary objective of the mooring system. A rack and pinion gear arrangement is therefore used whereby the rocker is the pinion and the support is the rack. In order to prevent any relative slippage the rolling surface of the rocker must be coincident with the pitch circle diameter of the gear geometry. For simplicity a circular arc has been used for the rocker and a flat surface for the support. However, any shape could be used for either, depending on the characteristics required. If the motion of the tanker at the effective pivot point is not sinusoidal but some type of step function this can be accommodated by changing the rocker shape. In practice the motion characteristics will continually change depending on the randomness of the sea condition and the response of the tanker. But the variations from the characteristics built into the rocker will probably be minimal from the riser fatigue loading viewpoint.

OVERALL SYSTEM DESCRIPTION

Figure 4:
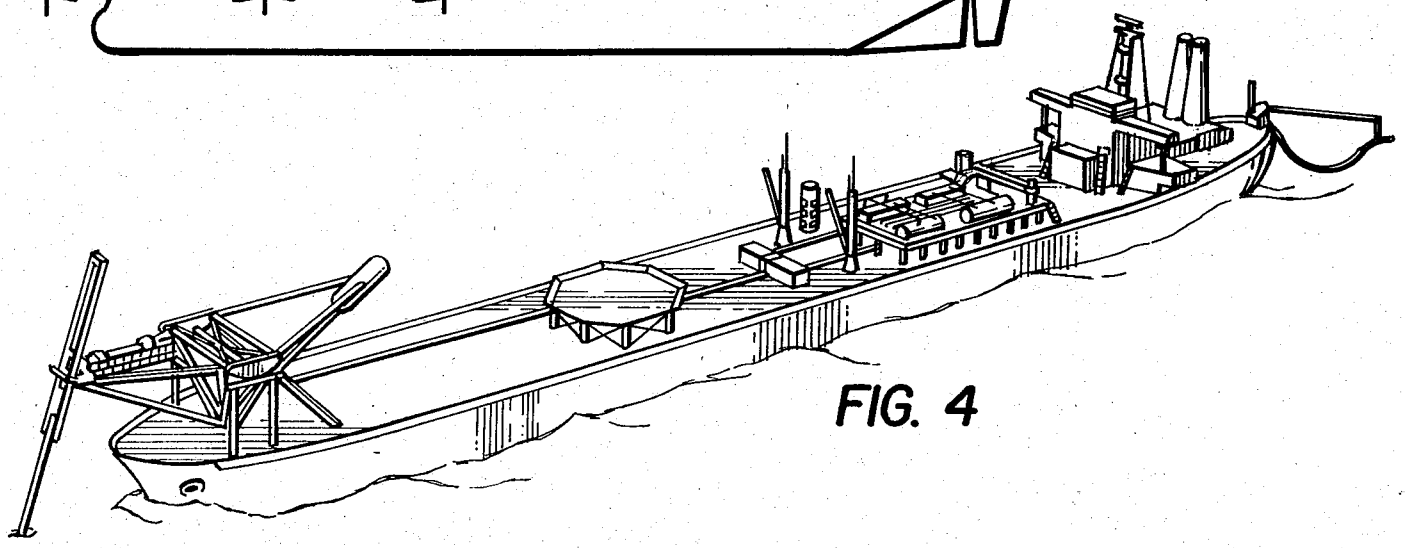
FIGS. 4 and 5 are perspective views of the invention.
Figure 5:
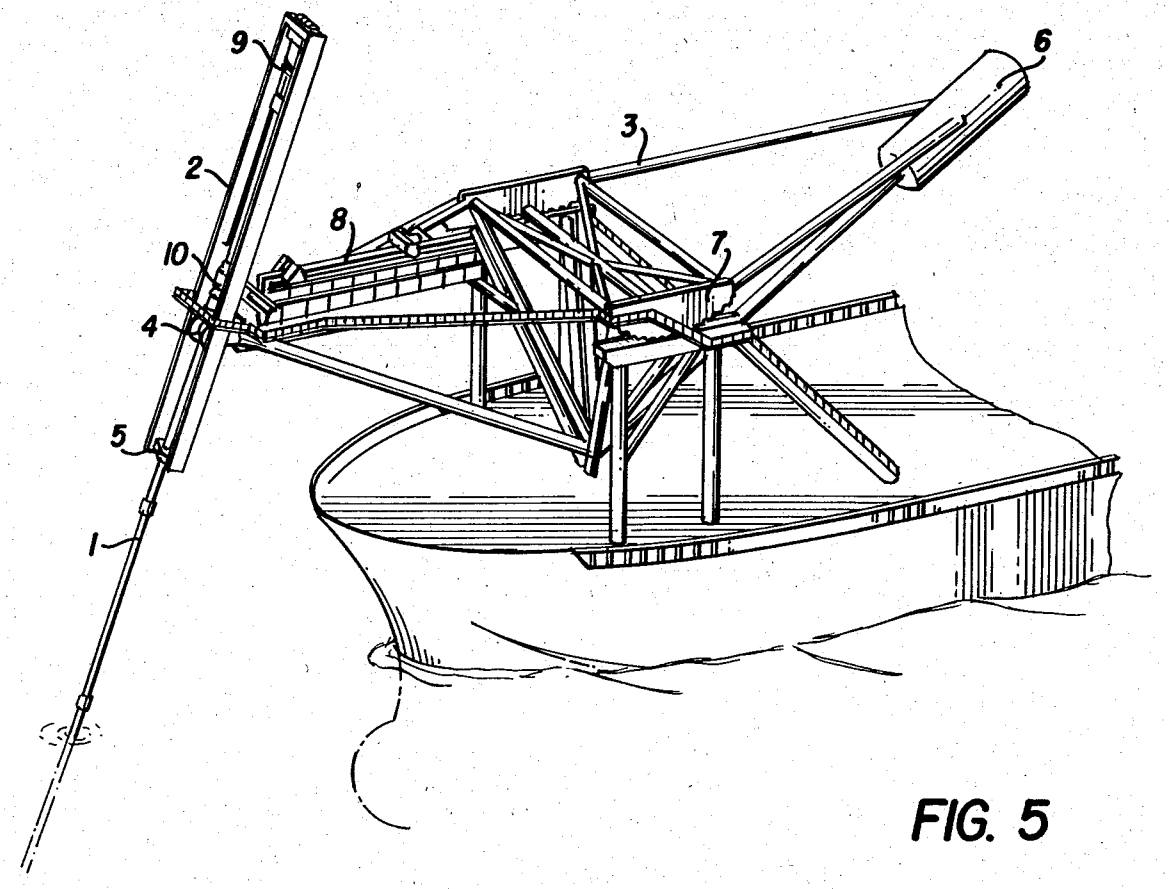

FIG. 4 shows the floating production vessel being moored by the riser. Although the arrangement shows the riser being deployed over the bow of the tanker it could also be deployed through a moonpool. A detail of the mooring and motion compensation equipment is shown in FIG. 5. The Riser (1) is attached to the riser support mast (2) by a thrust bearing whereby the riser is restrained from moving in all degrees of freedom except in rotation. Thus the tanker can rotate around the riser without twisting the riser. The riser support mast (2) is attached to the motion compensation rocking beam (3) by a gimbal (4) allowing the riser support mast to pivot in all directions. The riser support mast extends below the gimbal to enable a counterweight to be used to ensure that the mast stays nominally in a vertical position and reduce bending loads in the riser. At the lowest point of the riser support mast (2) a riser guide (5) is used to keep the riser support mast always aligned with the riser. The riser mast gimbal (4) is located at one end of a rocking beam (3). At the other end of the rocking beam is a weight in the form of a tank (6). The tank can be filled with water or other fluid to adjust the counter balance weight. The amount of weight required is enough to balance the equipment plus the riser tension load required. The rocking beam (3) sits on top of the rocking beam supports (7) which are located above the deck level at about half the height of the motion compensation stroke. This is to minimize the horizontal movement of the riser due to the gimbal end of the beam swinging through an arc. This feature is not critical to the overall function of the invention but is chosen as a helpful feature. The rocking beam (3) is shown as a space frame structure with the supports far apart. This not only allows a light structure to be used but allows riser side loads to be reacted easily at the supports. Horizontal loads, both fore and aft and side to side are reacted at the supports by the gear arrangement described earlier. As the beam rocks the curved surface on the beam rolls along the support surface. No sliding takes place because the pitch circle diameter of the gear teeth is coincident with the rolling/rocking surface. The movement produced by side loads of the riser or sideways inertia loads of the weight are reacted as differential loads on the gear teeth on each side of the beam. The actual side loads themselves are reacted as end load on the gear teeth or other suitable thrust surface.

The lengths of riser (called joints) are stored on the forward end of the beam in the riser loading and storage equipment (8). This equipment raises each piece of riser into the riser mast (2) where the riser handling equipment (9) is used to connect the riser joints together and lower it towards the seabed. When oil is being produced through the riser a multi pass swivel (10) is used on the top of the riser. Flex hoses and piping are used to transport the oil from the swivel to the process equipment on the tanker.

DESCRIPTION OF OPERATION

The attachment of the riser to the riser base on the seabed is done in the same way as described in patent application Ser. No. 619,734. The tanker is positioned over the riser base on the seabed. The riser mast (2) is located in a vertical position by hydraulic cylinders. The riser loading and storage equipment (8) then moves a length of riser towards the riser mast until the end is directly below the riser handling equipment (9). The riser handling equipment has a winch and travelling block arrangement similar to that normally used for handling drill pipe and casing on floating drill rigs, including a small stroke hydraulic motion compensator. This compensator is normally only used during the locking on of the riser to the riser base.

The travelling block of the riser handling equipment (9) locks onto the end of the riser and lifts it upwards. The riser then swings from a horizontal position to a vertical position in the riser mast. The lower end of the riser is guided by the riser loading equipment (8). With the riser joint (length of riser) in the vertical position it is lowered onto the lower riser package on an existing length of riser, and connected to it. The riser handling equipment (9) then lowers the complete riser assembly until the upper end of the riser reaches the support platform at the gimbal. Further joints of riser are then added in the same way.

When the correct length of riser has been layed out, the counter balance tank is filled with water so that the beam rocks and places the gimbal and riser mast near its highest position. The riser, with the last new joint of riser attached, is lowered towards the riser base by the riser handling equipment. Final positioning in a horizontal plane is done by moving the gimbal which will swing the riser over at an angle and the bottom of the riser will hang in a different location. Vertical motion combination during this operation is done grossly by the rocking beam but mainly by the handling equipment compensator. After the riser is locked to the riser base the tanker propulsion and station keeping system is shut down and the counterbalance tank filled with water to provide the correct riser tension. There are now no actively controlled systems working and the tanker drifts with the wave, wind and the current forces until the riser finds its equilibrium position.

The embodiments of the invention in which an exclusive property or privilege is claimed are defined as follows:

1. A weight type motion compensation system for a riser moored tanker said system comprising a rocking beam attaching a riser to said tanker, a weight attached to the end of the beam remote from the riser; pivot means providing a fulcrum point between the rocking beam and the tanker, said pivot means having means to move the fulcrum point away from the weight as the weight rises in response to the movement of the tanker and toward the weight as the weight falls in response to movement of the tanker, both movements of the fulcrum point being in a predetermined and repeating manner to compensate for inertial accelerations of said tanker.

2. A system according to claim 1 wherein the weight comprises a fluid-filled tank.

3. The system of claim 1 in which the means to move the fulcrum point comprises a rack and gear arrangement between the rocking beam and the tanker.

4. The system of claim 3 in which the means to move the fulcrum point comprises a toothed gear on one of said rocking beam and rocking beam support and intermeshing teeth on the other of said rocking beam and rocking beam support.

5. The system of claim 4 including means to limit side to side movement between the toothed gear and the intermeshing teeth.

6. The system of claim 3 in which the means to move the fulcrum point comprises a rack on one of said rocking beam and rocking beam support and a gear intermeshing with said rack on the other of said rocking beam and rocking beam support.

7. The system of claim 3 including a generally vertical riser support mast at the first end of the rocking beam attached by gimbal pivot means.

8. The system of claim 7 including means on said riser support mast for handling equipment to be secured to said riser.

9. The system of claim 8 including means adjacent the first end of the rocking beam for loading and storage of equipment to be secured to said riser.

10. The system of claim 7 including a riser guide adjacent the lower end of said generally vertical riser support mast.

11. A method of mooring a ship-shape floating production system by means of a deployable riser tensioned by a weight type motion compensation system mounted on the deck of said floating production system comprising using a rocker beam to reduce load fluctuation in the riser caused by the inertia of said weight and transmitting horizontal force on the rocker beam through the use of a rack and gear arrangement and wherein the pitch circle diameter of the gear teeth is coincident with the rolling surface of the rocker.

12. A weight type motion compensation system for mooring a tanker to a riser extending up from the seabed, said system comprising:

a tanker having a deck;

a rocking beam support mounted on said deck;

a motion compensation rocking beam pivotally supported on said rocking beam support and having a first end extending over the edge of the deck;

a weight attached to a second end of said rocking beam remote from said first end;

pivot means between the first and second ends of the rocking beam providing a fulcrum point between the rocking beam and the rocking beam support, said pivot means having means to move the fulcrum point away from the second end as it rises in response to the movement of the tanker and to move the fulcrum point toward the second end as it falls in response to movement of the tanker, both movements of the fulcrum point being in a predetermined and repeating manner.

13. The system of claim 12 in which the weight at the second end of the rocking beam comprises a tank for filling with a liquid.

14. A method of mooring a ship-shaped floating production system by means of a deployable riser extending from the seabed, said method comprising:

mounting a weight type motion compensation mechanism having a rocking beam with a weight at its inboard end on the deck of the floating production system;

securing the riser to the outboard end of said rocking beam;

pivoting said rocking beam by a fulcrum point in the midportion of said beam;

moving said fulcrum point away from the inboard end of the rocking beam as the inboard end rises in response to movement of the floating production system and moving the fulcrum point toward the inboard end as it falls in response to movement of the floating production system.

* * * * *